United States Patent [19]

Clarke, Jr. et al.

[11] Patent Number: 4,789,266

[45] Date of Patent: Dec. 6, 1988

[54] SELF-PROPELLED CONSTRUCTION APPARATUS

[75] Inventors: Samuel Y. Clarke, Jr., Mocksville; Clifford J. Griffith, Jr., Clemmons, both of N.C.

[73] Assignee: Power Curbers, Inc., Salisbury, N.C.

[21] Appl. No.: 125,999

[22] Filed: Nov. 27, 1987

[51] Int. Cl.[4] ..... E01C 19/22; E01C 19/46

[52] U.S. Cl. ..... 404/96; 404/98; 404/104; 404/105

[58] Field of Search ..... 404/84, 98, 96, 101, 404/105, 108–110; 425/458

[56] References Cited

U.S. PATENT DOCUMENTS

| | | | |
|---|---|---|---|
| 2,128,273 | 8/1938 | Stevens | 404/84 X |
| 3,218,944 | 11/1965 | Larsen et al. | 404/98 |
| 3,292,511 | 12/1966 | Cheney | 404/84 |
| 3,466,990 | 9/1969 | Toles | 404/84 |
| 3,606,827 | 9/1971 | Miller et al. | 404/84 |
| 3,710,695 | 1/1973 | Miller et al. | 404/98 |
| 3,749,504 | 7/1973 | Smith | 404/84 |
| 3,749,505 | 7/1973 | Miller et al. | 404/98 |
| 3,779,662 | 12/1973 | Smith | 404/98 |
| 3,856,425 | 12/1974 | Miller et al. | 404/84 |
| 3,864,858 | 2/1975 | Rochfert | 404/98 |
| 3,936,211 | 2/1976 | Miller et al. | 404/104 |
| 3,967,913 | 7/1976 | Gabriel, Jr. | 404/109 |
| 3,969,035 | 7/1976 | Silbernagel | 404/98 |
| 3,970,405 | 7/1976 | Swisher, Jr. et al. | 404/105 |
| 3,981,603 | 9/1976 | Sprunger | 404/98 |
| 3,989,402 | 11/1976 | James, III | 404/110 |
| 4,029,165 | 6/1977 | Miller et al. | 404/98 X |
| 4,041,623 | 8/1977 | Miller et al. | 404/84 X |
| 4,073,592 | 2/1978 | Godberson et al. | 404/105 X |
| 4,097,173 | 6/1978 | Tout | 404/98 |
| 4,140,193 | 2/1979 | Miller | 404/84 X |
| 4,197,032 | 4/1980 | Miller | 404/98 |
| 4,215,949 | 8/1980 | Gabriel, Jr. | 404/109 X |
| 4,319,859 | 3/1982 | Wise | 404/98 X |
| 4,360,293 | 11/1982 | Wade | 404/96 X |
| 4,526,493 | 7/1985 | Hall et al. | 404/105 |
| 4,571,119 | 2/1986 | Jones et al. | 404/98 X |
| 4,676,689 | 6/1987 | Yant | 404/110 |

*Primary Examiner*—Stephen J. Novosad
*Assistant Examiner*—John F. Letchford
*Attorney, Agent, or Firm*—Bell, Seltzer, Park & Gibson

[57] ABSTRACT

A self propelled construction apparatus for continuously forming a paving material on a suitable surface such as the ground. The apparatus is capable of performing a variety of molding operations. The main frame of the apparatus is so constructed as to be adjustably extended outwardly longitudinally for wide width paving. Also, the apparatus can be laterally adjusted to perform narrow width paving. The apparatus may have an offset mold on either side thereof for offset molding or a mold underneath the main frame for molding between the ground engaging means. Further, means for mounting and connecting the mold to the main frame allows the mold to be moved angularly on a vertical axis from an operative position alongside the main frame to a transport position at the end of the substantially aligned with the main frame.

14 Claims, 9 Drawing Sheets

SELF-PROPELLED CONSTRUCTION APPARATUS

FIELD OF THE INVENTION

This invention relates generally to construction machines for forming a paving material onto a suitable surface such as the ground, and more particularly to a multipurpose paving machine that can pave roadways as well as form curbs, gutters, spillways, sidewalks, troughs, barriers and other continuous concrete extrusions.

BACKGROUND OF THE INVENTION

Machines for continuous concrete forming have developed into two general types of machines. The first type is a relatively large machine for paving roadways wherein a paving apparatus is suspended below the construction machine for spreading out and finishing the surface of concrete that has been poured or deposited on the ground in front of the machine. The second type is a machine carrying a mold for forming the concrete into a particular cross-sectional shape such as a curb, gutter, barrier or the like. These machines have generally been smaller than the larger highway paving machines. A mold may be positioned beneath the machine, but it is generally positioned to one side of the machine for offset molding, particularly when molding a relatively tall form such as a highway barrier or the like.

These two types of machines have been improved by developments in the control and operation of such machines. Such improvements have included the use of hydraulic cylinders to adjust the height and attitude of such machines. Control systems have been devised that cause the machine to automatically follow a predetermined path or guideline. This high technology has significantly improved the quality of the finished product, however, it has greatly increased the cost of each machine. A construction contractor must be able to have substantial use of any particular machine to economically justify the purchase. In this regard, many contractors do a variety of jobs, big and small, and cannot justify the costs of two machines. However, at the same time that technological developments have made it desirable to have a machine that can accomplish both paving and molding, the cost of land has increased at a substantial rate. Accordingly, developers have designed subdivisions with streets and cul-de-sacs that are smaller and tighter. In order to mold a curb of such dimension, it has been necessary for the developer to have a small compact machine with the ability to follow the tight turns necessary under these situations. Thus, machines that have been designed to be capable of performing both paving and offset molding operations have not been entirely successful.

Another problem associated with these machines, particularly machines of a substantial size, is the ability to transport them to a new location. The problem comes about because these machines oftentimes exceed the size restrictions allowed for a load on a highway. Generally, transporting of these machines has been accomplished by one of two methods. The first method being that the device is disassembled to the extent that it would fit on a trailer within the legal limits. This process of course consumes substantial time and effort increasing the cost of using such machines. The second method for transporting construction machines of this sort on a trailer has been to obtain an authorizing permit for carrying oversized equipment on the highway. This, of course, has the accompanying problem of having to obtain a permit every time the machine is to be transported.

Another problem associated with performing a paving operation is in instances where the roadway is narrow. Prior art machines have been too wide to fit into some narrow streets to pave. This is experienced particularly in Europe where many buildings are located close together and the streets are quite narrow.

SUMMARY OF THE INVENTION

It is a primary object of the invention to overcome the problems in the prior art as discussed above by providing an apparatus wherein, particularly the main frame and ground engaging means are arranged for selective adjustment and selective orientation so as to permit the apparatus to be used in wide and narrow paving, and for molding using an offset or underneath mold.

Another object of the invention is to provide a mold attachment for easy positioning of the mold in an offset operative position alongside the main frame or in a transport position substantially longitudinally aligned with the main frame without removal of the mold from the main frame.

In accordance with the invention, applicant provides a self-propelled construction apparatus for continuously forming a selected type or shape of paving on a suitable surface such as the ground. The apparatus comprises a longitudinally and transversely adjustable main frame including a body having a front end and a rear end. At least one pair of independently and longitudinally adjustable substantially horizontal beam members are connected to the body at one of the ends and define one end of the main frame. The apparatus further includes front and rear movable ground engaging means and means connected to the ground engaging means for connecting the ground engaging means to the main frame at respective ends thereof for supporting the main frame and varying the height of the main frame above the ground. Further, the front pair of ground engaging means may selectively have one of the pair of ground engaging means removed to provide a three point ground engaging paving apparatus for facilitating offset or side molding.

Some of the objects of the invention having been stated, others will appear as the description proceeds when taken in connection with the accompanying drawings, in which FIG. 1 is a perspective view of one embodiment of the self-propelled construction apparatus according to this invention shown equipped with an offset mold for molding a curb and gutter adjacent the left-hand side of the main frame of the apparatus;

Figure 23:
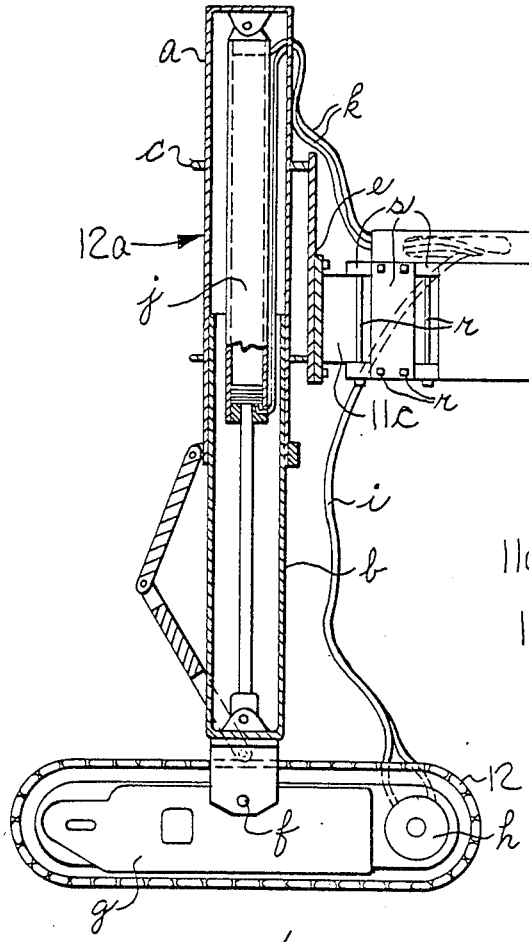
Figure 24:
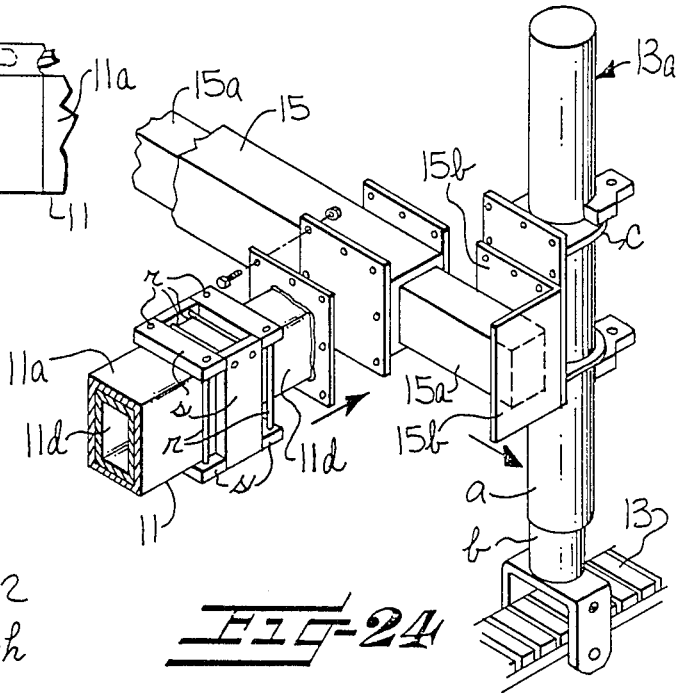

FIG. 23 is a fragmentary vertical sectional view through one of the movable ground engaging means, and illustrating a topical fluid pressure operated apparatus for adjusting the height of the respective movable ground engaging means; and FIG. 24 is a fragmentary isometric view, partially exploded to illustrate the manner in which a corresponding ground engaging means may be mounted for being adjusted laterally of the apparatus as well as being adjustable longitudinally of the main frame, i.e. forwardly and rearwardly of the construction apparatus.

DETAILED DESCRIPTION

At the outset it should be noted that the self-propelled construction apparatus of the present invention is structured to accommodate a variety of implements, such as molds and auxiliary equipment for use in the paving industry. Accordingly, it will be observed that the construction apparatus of the present invention comprises a main frame, broadly designated at 10 (FIGS. 3–24), which includes a body 11 having left-hand and right-hand side frame portions 11*a*, 11*b* of generally tubular construction.

Figure 3:
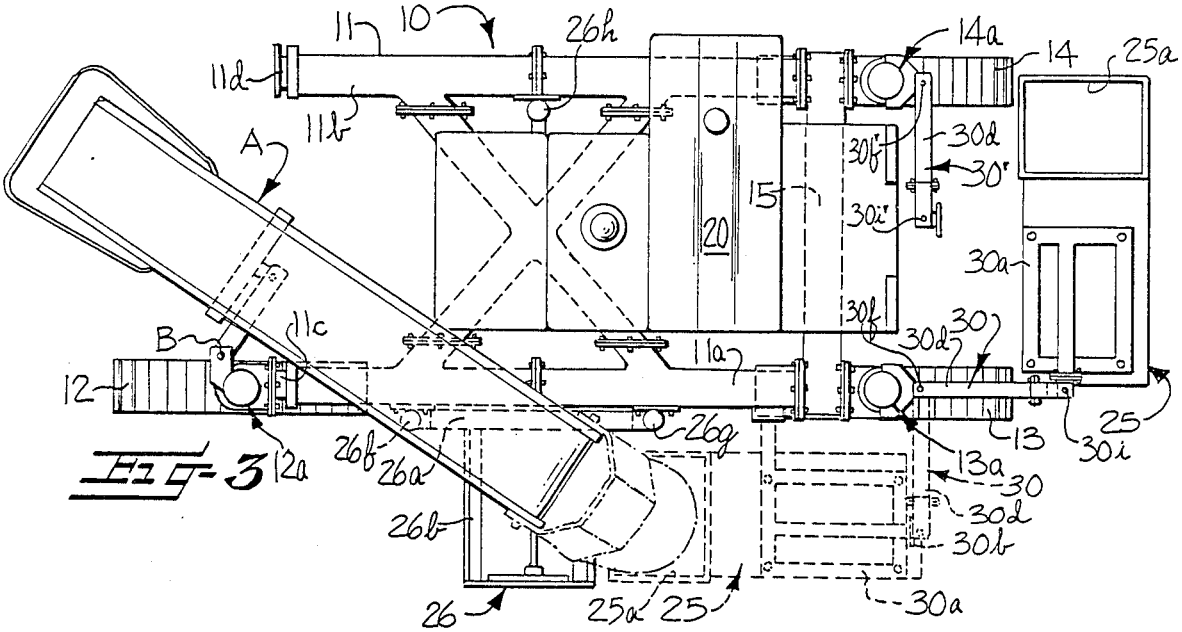
FIG. 3 is a top plan view of the apparatus shown in FIG. 1.

The front portions of the side frame portions 11*a*, 11*b* in FIG. 3 telescopically receive therein a respective pair of front independently and longitudinally adjustable substantially horizontal beam members 11*c*, 11*d*, and a similar pair of longitudinally adjustable substantially horizontal beam members 11*h* and 11*i* are telescopically received in the rear end portions of the side frame portions 11*a*, 11*b* of the frame body 11.

Figure 4:
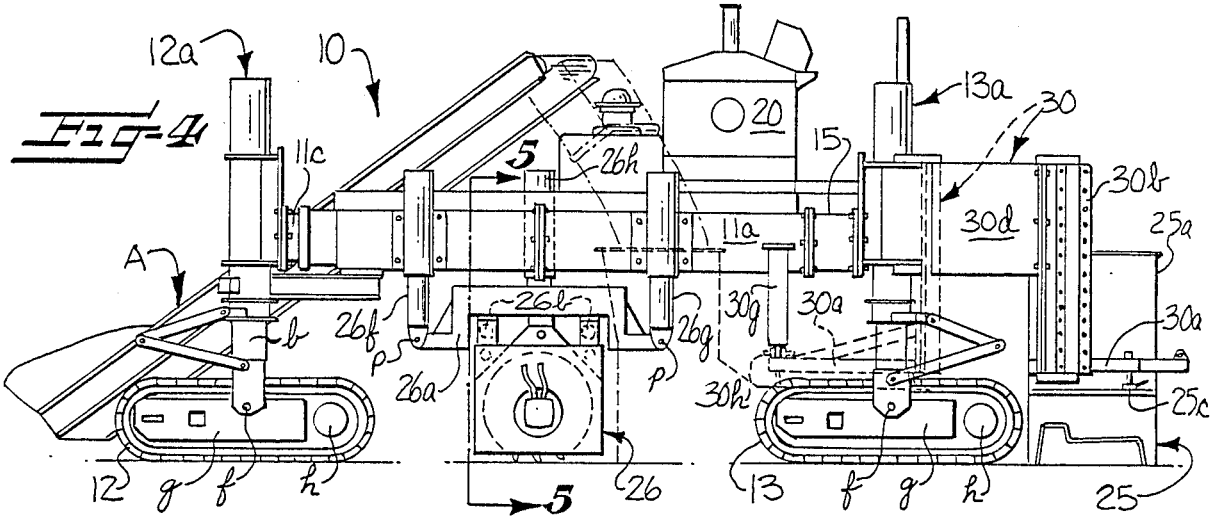
FIG. 4 is a left-hand side elevation of the apparatus shown in FIG. 1.

In the arrangement of the construction apparatus as shown in FIGS. 3 and 4, a single front movable ground engaging means, preferably in the form of an endless track 12, is connected by suitable connecting means, broadly designated at 12*a*, to the front end of one of the front longitudinally adjustable substantially horizontal beam members 11*c*, 11*d*. In this instance (FIGS. 3 and 4), the front endless track 12 is connected, via the connecting means 12*a*, to the front end of the front left-hand longitudinally adjustable beam member 11*d*. The same or a similar front end supporting ground engaging means or track 12' may be attached to the front end portion of the right-hand substantially horizontal beam member 11*c*, when desired. However, the right-hand front track is omitted in FIGS. 3 and 7 since it is not needed when using a relatively small molding means on the other left-hand side of the apparatus.

The rear end of the self-propelled construction apparatus as shown in FIGS. 3 and 4, is provided with a pair of laterally spaced rear movable ground engaging means or tracks 13, 14 which are connected by respective connecting means, broadly designated at 13*a*, 14*a*, and a transverse, interconnecting tubular rear end frame member 15 to the rear ends of the rear longitudinally adjustable substantially horizontal beam members 11*h*, 11*i*. Since the transverse frame member 15 of main frame 10 is detachably secured to the rear ends of the rear longitudinally adjustable beam members 11*h*, 11*i* (FIGS. 5, 19–21 and 24), which are in turn telescopically received in the rear portions of the side frame portions 11*a*, 11*b* of main frame 10, it is apparent that the rear pair of tracks 13, 14 may be adjusted forwardly and rearwardly with respect to the main frame 10.

In order to adjust the main frame for varying the height thereof above the ground, each of the connecting means 12*a*, 12*a'*, 13*a*, 14*a*, connecting the respective tracks 12, 12', 13, 14 to the main frame may be constructed in the same manner and substantially as shown more in detail in FIG. 23. Front connecting means 12*a*and the corresponding track or ground engaging means 12 are illustrated by way of example. Accordingly, it will be observed in FIG. 23 that the connecting means 12*a* comprises a pair of upper and lower telescopically interconnected hollow posts or columns a, b, which are of substantially circular cross section, the upper portion of the lower column b, being positioned within and in sliding engagement with the upper column a.

A medial portion of the upper hollow column a in FIG. 23 is clampingly secured in a bracket means c by any suitable means. The bracket means c is bolted or otherwise detachably secured, as by bolts e, to the flanged outer or front end of the respective substantially horizontal adjustable beam member 11*c*. The lower end of the lower hollow column b is pivotally secured, as at f, to the frame g of the respective movable ground engaging means or track 12. In this regard, the track 12 may be of conventional construction well known in the art, and, accordingly a detailed description thereof is deemed unnecessary. It will be noted that the track is equipped with the usual drive motor h for imparting forward and rearward motion to the track 12 in FIG. 23 at the will of the operator.

Such motors are usually operated by fluid pressure such as hydraulic fluid and, therefore, suitable fluid pressure lines i extend from the motor h (FIG. 23) to a manually controlled source of fluid pressure or hydraulic fluid shown schematically at 20 in FIGS. 1–4. It will be observed in FIG. 1 that the fluid pressure source 20 is controlled by a plurality of manually operable control elements 20*a* as is conventional. Thus, the source of fluid pressure 20 also serves as and may be termed as a prime mover for the entire construction apparatus.

Referring again to FIG. 23, it will be observed that the closed upper and lower distal ends of the upper and lower columns a, b have respective opposite ends of a fluid pressure ram or cylinder j connected thereto. Fluid pressure lines k extend from opposite ends of the cylinder component of the ram j to the fluid pressure source or motive means 20.

Figure 21:
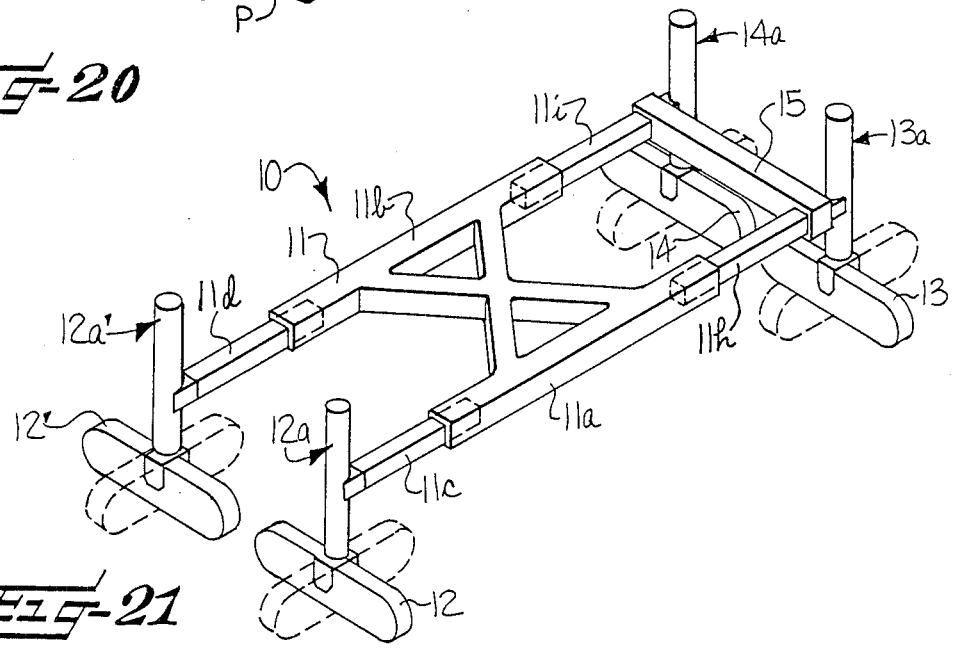
FIG. 21 is an isometric view of the main frame illustrating the different position that the ground engaging means or tracks may occupy to accommodate the forming of a wide strip of paving material.

It is thus apparent that the lower hollow column b in FIG. 23 may be readily raised and lowered or retracted and extended relative to the .upper hollow column a by manipulation of the control elements 20*a* in a well known manner. From the foregoing description of FIG. 23, it is apparent that each of the tracks 12, 13, 14 may be adjusted vertically relative to the main frame 10 and independently of each other. It should be noted that, in addition to each of the lower columns b being vertically adjustable relative to the respective upper tubular column a, the lower tubular column b (FIG. 23) is also adjustable about its own axis under control of the motive means or prime mover 20, not only for the purpose of steering the apparatus, but for also turning or reorienting each respective ground engaging means or track about its steering axis so the direction of travel of the apparatus can be forward or backward of the frame or toward either side as illustrated in FIG. 21, for example.

Figure 9:
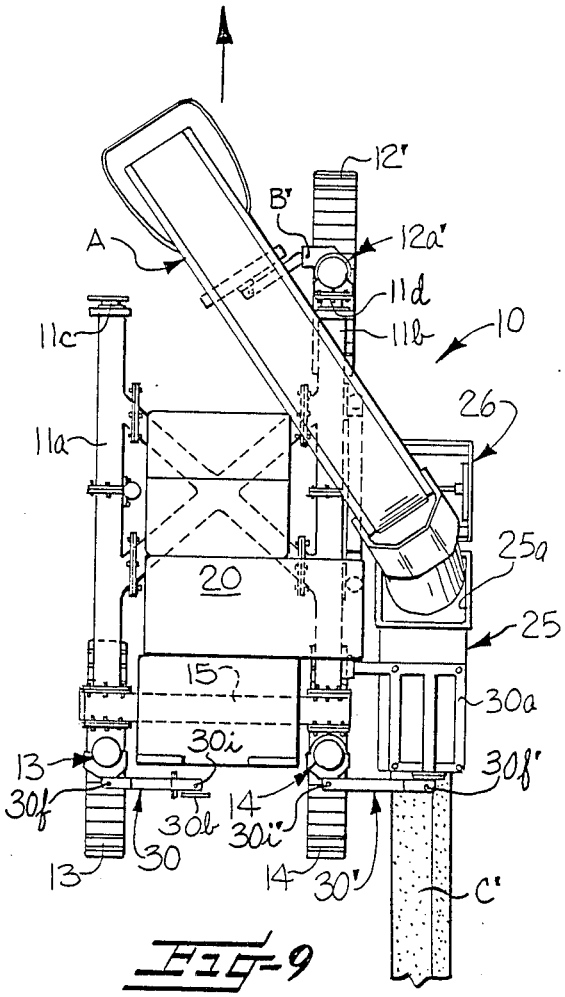
FIG. 9 is a top plan view of the apparatus as shown in FIG. 8.
Figure 10:
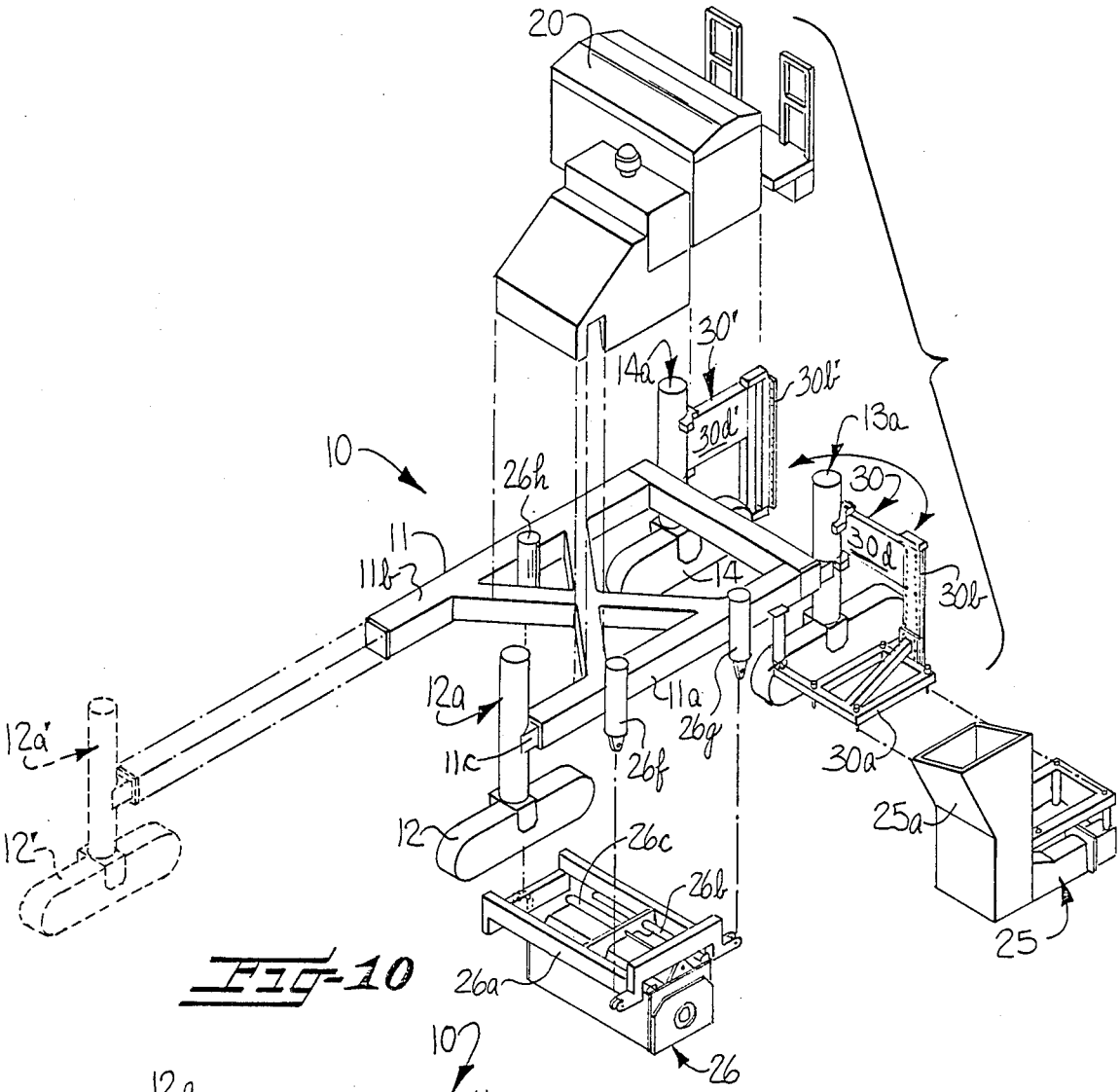
FIG. 10 is a partially exploded schematic isometric view of the construction apparatus.
Figure 11:
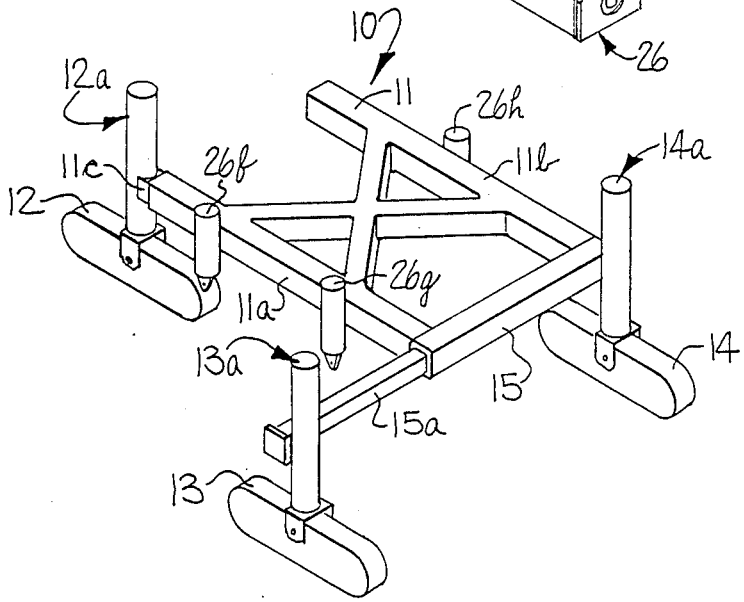
FIG. 11 is a schematic isometric view of the main frame of the apparatus showing one of the movable ground engaging means in a laterally outwardly extended position as compared to that in which it is shown in FIG. 10.

As heretofore indicated, the connection means 13*a*, 14*a* for the rear pair of ground engaging means or tracks 13, 14 are detachably connected to the body 11 of the main frame 10 via the hollow or tubular transverse beam member 15 (FIGS. 3, 10 and 11). As best shown in FIGS. 3, 5, 7 and 9, instead of the upper tubular column a of the track connecting means 13*a* being secured to the front surface of the tubular transverse frame member 15 of the main frame, as is the case with connecting means 14*a*, the connecting means 13*a* (FIG. 24) is detachably secured to the left-hand end of a substantially horizontal transverse beam member 15*a* slideably mounted within and extending longitudinally of the transverse frame member 15.

In order to facilitate the detachable securement of the upper column a of the connecting means 13*a* to the outer end of the transverse beam member 15*a*, beam member 15*a* has a bracket 15*b* suitably secured thereto, as by welding (FIG. 24). The bracket 15*b* is substantially L-shaped in plan and its wing portion 15*b'* shaped outwardly or rearwardly of the transverse beam member 15*a* for receiving suitable detachable fastening elements, such as bolts 15*c*, for detachably securing the corresponding bracket means c to the rear face of the wing portion 15*b'*.

By referring to FIG. 24 it is apparent that the outer or rear wing portion or leaf 15*b'* of the bracket means 15*b* is spaced rearwardly from the transverse beam member 15*a* so that the bracket 15*b* may be moved or positioned close to the adjacent end of the hollow frame member 15 with the wing portion 15*b'* of the bracket means 15*b* overlapping the corresponding or left-hand end of the transverse frame member 15.

Figure 5:
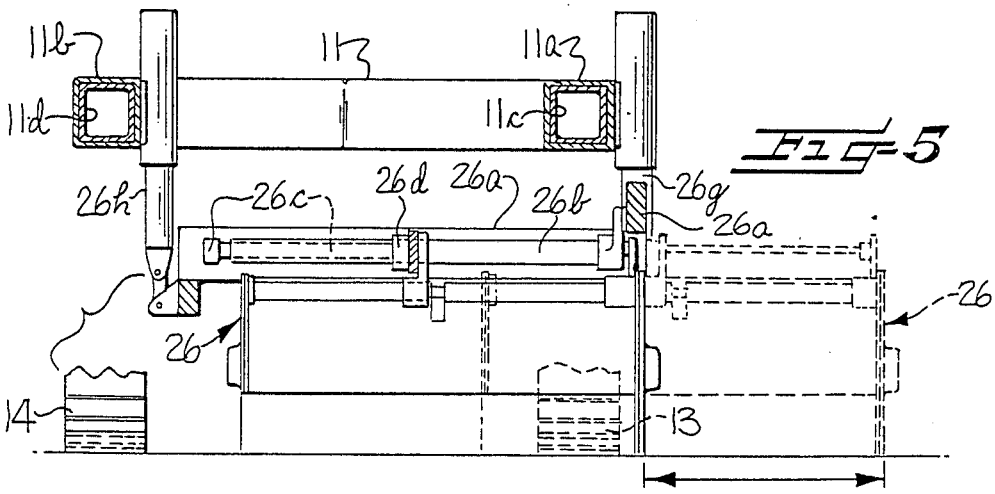
FIG. 5 is an enlarged fragmentary vertical sectional view taken substantially along line 5-5 in FIG. 4, showing a ground trimmer suspended beneath the main frame of the apparatus, and with some parts being omitted for purposes of clarity.
Figure 6:
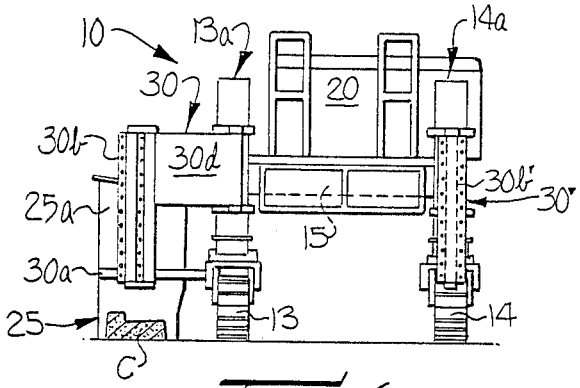
FIG. 6 is a rear elevation of the construction apparatus of FIG. 1, and in which a curb and gutter molding means is shown in operative position on the left-hand side of the apparatus.

According to this invention, the construction apparatus is structured for use with a variety of molds as well as other or auxiliary equipment aiding in the continuous molding operation. Such a mold is shown in FIGS. 1–7 in the form of a combination curb and gutter molding means 25 offset to the left-hand side of the forward path of travel of the construction apparatus when in use. FIGS. 1–5 and 10 also include a trimmer 26 which is detachably mounted to the main frame 10 and in advance of the molding means 25 for grading the ground surface and for conveying the excavated ground material to one side thereof. The trimmer may be of the general type disclosed in Miller's U.S. Pat. No. 4,197,032. Accordingly, a further more detailed description of the trimmer is deemed unnecessary, it being noted however that fluid pressure rams 26*f*, 26*g*, 26*h* or combination cylinders and pistons are carried by the main frame 10 (FIG. 3) with their movable components connected, by removable pins p, to opposite sides of the trimmer 26 by way of an intervening carriage 26*a* (FIGS. 3, 4 and 5).

The carriage is provided with transverse bars 26*b* which extend transversely of the construction apparatus and on which sleeves or bearings 26*d* are mounted to permit bearings 26*d* are mounted to permit lateral adjustment of the trimmer 26 with respect to the main frame body 11 by means of a fluid pressure ram 26*c*. Such lateral adjustment of the trimmer facilitates positioning the trimmer 26 forwardly of and in alignment with the molding means 25 on the left-hand side of the construction apparatus and will also permit positioning the trimmer forwardly of and in alignment with a right-hand molding means 25' such as that shown in FIGS. 8 and 9.

Although it is not intended that the left-hand molding means and the right-hand molding means be used or mounted on the construction apparatus at the same time, since they may be quite similar, except for being opposite hand from each other, only the left-hand molding means 25 (FIGS. 1–4) will be described in detail and similar parts of the right-hand molding means 25' and its associated mounting means will bear the same reference characters with the prime notation added in order to avoid repetitive description. The molding means 25 is embodied in a slip form mold having an open-topped upper hopper portion 25*a* whereby paving material can be received from the upper discharge end of a forwardly and downwardly extending endless belt conveyor means A and will be deposited on the ground surface through the mold portion 25b which has an open bottom and open rear end. Of course, continuous strips of paving material, such as concrete or the like, can thereby be formed into continuous curbs and gutters, the mold portion 25b being shaped to form a left-hand combination curb and gutter C (FIGS. 1, 2 and 6), and the mold portion 25b' being shaped or formed so as to form the right-hand combination curb and gutter C' (FIG. 8).

Figure 8:
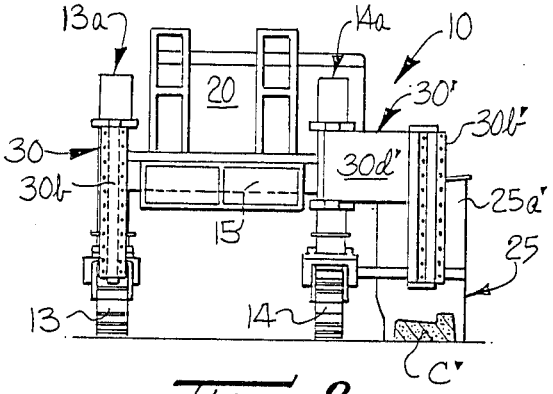
FIG. 8 is a view similar to FIG. 6, but illustrating a curb and gutter molding means positioned on the right-hand side or opposite side of the apparatus from that shown in FIG. 6.
Figure 7:
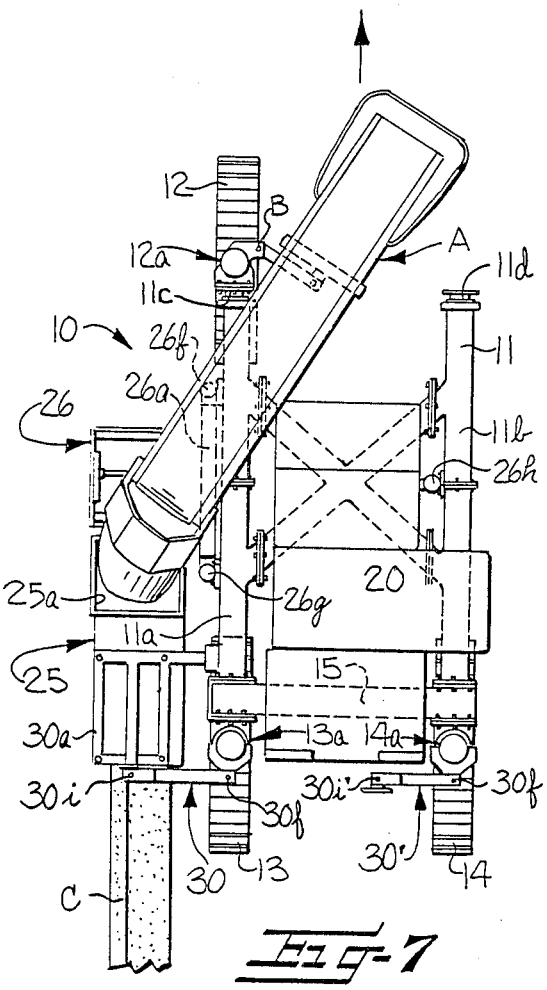
FIG. 7 is a top plan view of the construction apparatus as shown in FIG. 6.

In this regard, it will be observed in FIGS. 7 and 8 that an endless belt conveyor means A occupies a position in FIG. 7 extending forwardly and inwardly to the right of the forward left-hand portion of the longitudinal frame portion 11a of the main frame 10. Since the conveyor means A is detachably secured, as at B (FIG. 3), to the main frame 10, it is apparent in FIG. 9 that the position of the conveyor means has been changed in FIG. 9 so that the conveyor means thus indicated at A' extends downwardly and inwardly to the left in FIG. 9 and overlies the frame portion 11b instead of the frame portion 11a of the main frame 10 so as to accommodate the righthand molding means 25'.

Also, since the ground engaging means or track 12 and its connecting means 12a are detachably secured to the front end of the left-hand longitudinally adjustable beam member 11c (FIG. 23), in order to aid in balancing the weight of the conveyor A' and the right-hand molding means 25' now on the right-hand side of the apparatus in FIG. 9, the ground engaging means 12 and its connecting means 12a have been detached from the front end of the left-hand substantially horizontal beam member and the same left-hand ground engaging means 12 and its associated connecting means 12a or another or similar ground engaging means 12' and connecting means 12a' is detachably secured to the front end end of the right-hand horizontal beam member 11d in the same manner as that described with respect to the structure illustrated in FIG. 23. Preferably, when the right-hand molding means 25' is installed to the apparatus, the left-hand molding means 25 is detached from the apparatus.

Referring again to the molding means 25, it will be observed in FIGS. 1–10 that the construction apparatus is provided with mold mounting means 30, 30' at the rear left-hand and right-hand side portions of the apparatus, respectively. As heretofore indicated, since the left-hand and right-hand mounting means 30, 30' are similar except being opposite hand, the same reference characters will be applied to the right-hand mold mounting means 30' as are applied to the left-hand mounting means 30, with the prime notation added to avoid repetitive description. The mounting means 30 is an embodiment of means supportingly connecting the molding means 25 to the main frame 10 so that the molding means 25 can be used in its usual operative position while depositing and forming the paving material on the ground, and the molding means 25 can remain attached to the construction apparatus via the mounting means 30 during movement or transport of the apparatus from place to place. Thus, the mounting means 30 supports the molding means for angular movement about a vertical axis between a first operative position laterally offset of the main frame 10 (FIGS. 1 and 2), and a second inoperative or transport position (FIGS. 3 and 4) adjacent the rear end of the main frame.

Accordingly, it will be observed in FIGS. 1–4 that the mold mounting means 30 comprises a substantially horizontal, substantially rectangular frame which overlies and is detachably secured to the mold portion 25b of the molding means 25, as by bolts or screws 25c. The rear end of the frame 30a of the mounting means 30 is suitably detachably secured, for vertical adjustment, to a lower portion of a post or column 30b. In this regard, it will be observed in FIG. 12 that the construction apparatus is shown equipped with a different form of mold than is the case in FIGS. 1–4, 6 and 7, the molding means in FIG. 12 being indicated at 125 and having a mold portion 125b shaped for forming a barrier wall of substantially greater height than the combination curb and gutter C shown in FIG. 1. Thus, it is apparent that the frame 30a is adjustably secured for vertical adjustment to the column or post 30b so that molding means of varying heights may be readily secured to and detached from the substantially upright post or column 30b. To this end, it will be observed in FIG. 2 that the post 30b provided with a plurality of holes arranged in a vertical row thereon for receiving suitable bolts or screws 30c for facilitating vertical adjustment of the frame 30a.

Figure 1:
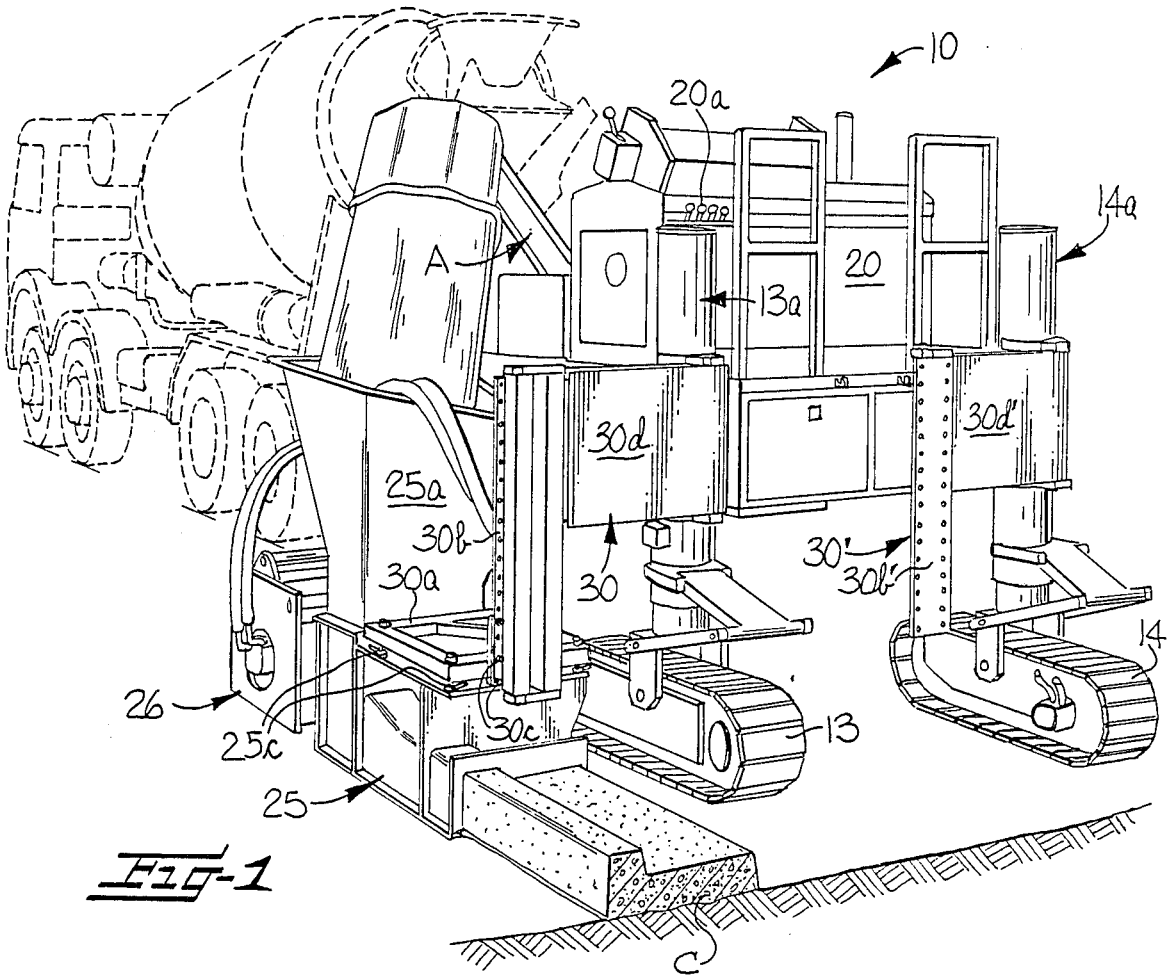
Figure 2:
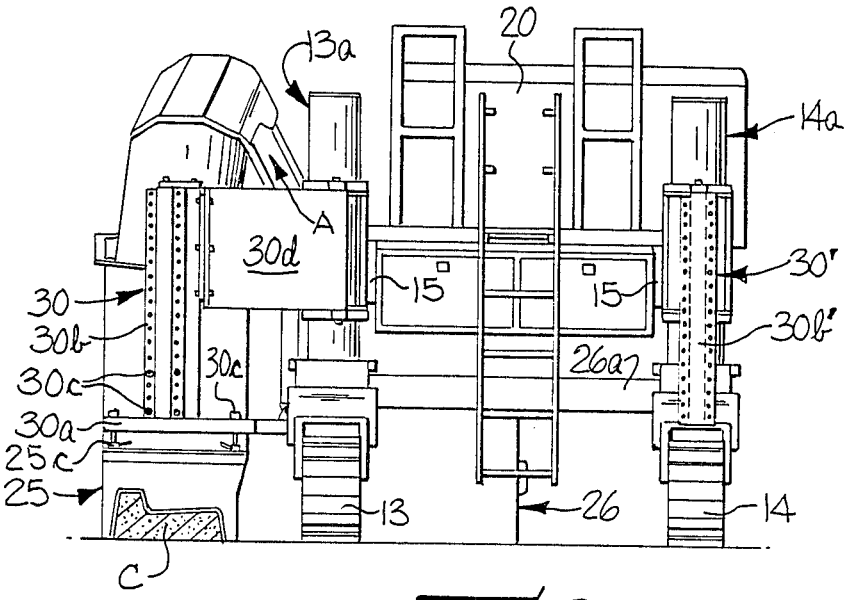
FIG. 2 is a rear elevation of the construction apparatus of FIG. 1.
Figure 12:
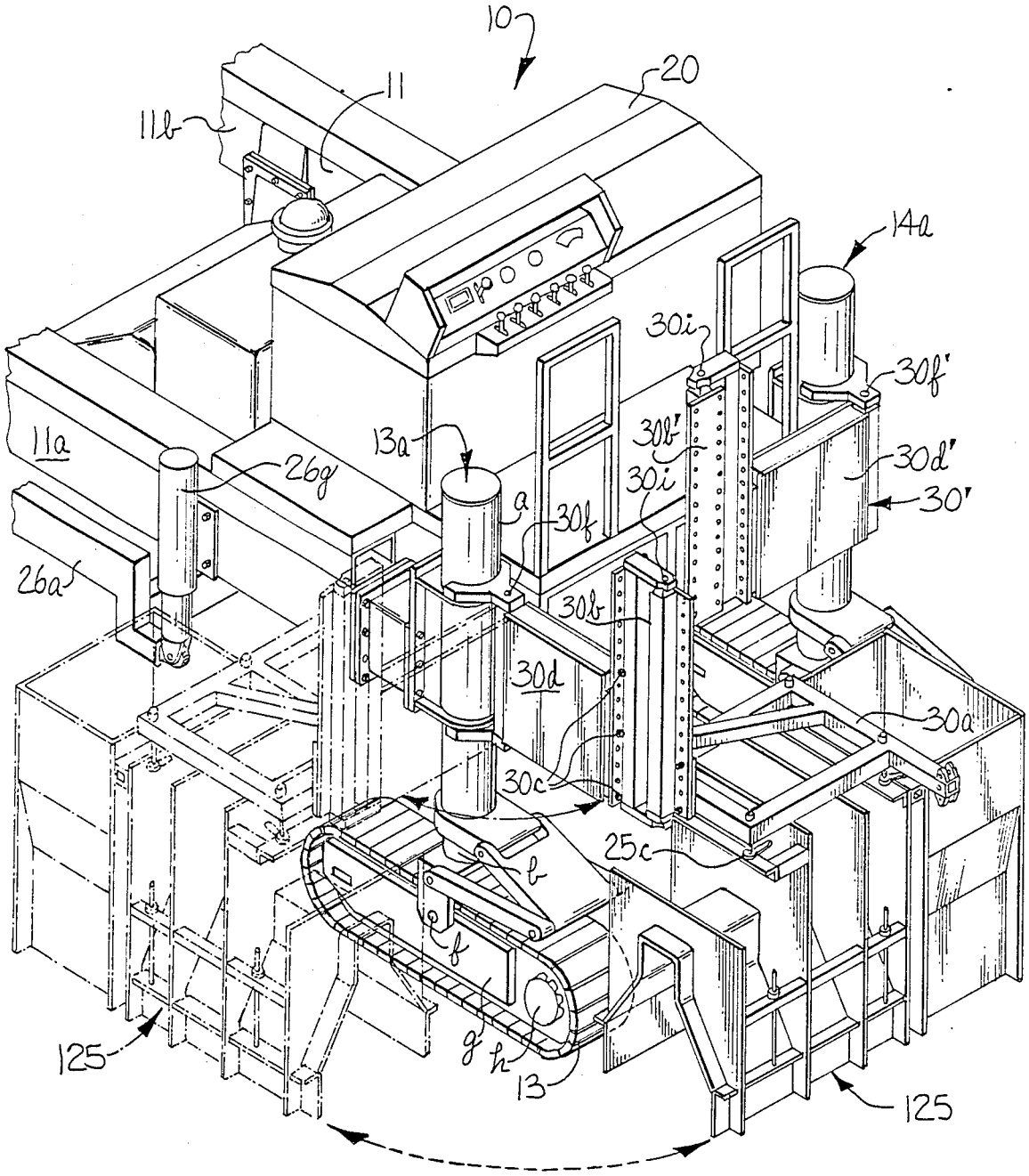
FIG. 12 is an enlarged isometric view similar to FIG. 1, but showing a concrete barrier wall molding means mounted to the construction apparatus in place of the curb and gutter molding means of FIG. 1, and wherein the barrier wall molding means is shown occupying an inoperative, transport position in solid lines and an offset operative position in broken lines.
Figure 13:
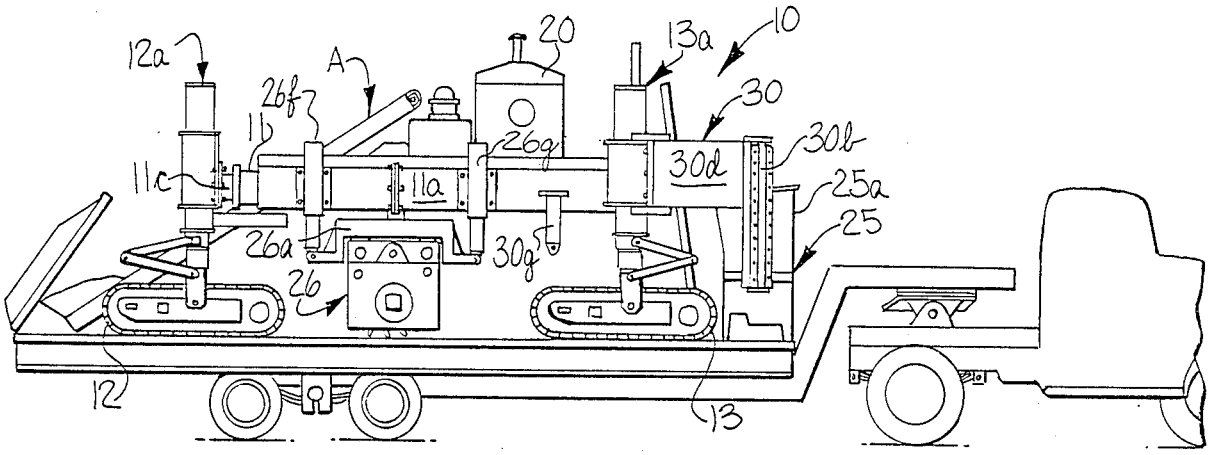
FIG. 13 is a side elevation of the construction apparatus of the present invention showing the same in a transport mode and also showing the same upon a trailer behind a tractor.

As best shown in FIGS. 1 and 3, the upper portion of the post 30b is pivotally secured or hingedly secured, as at 30i, to a swingable bar or hinge plate 30d for pivotal movement about a substantially vertical axis. The plate 30d extends inwardly and is pivotally connected for moving about a vertical axis, as at 30f (FIG. 12), to an upper portion of the respective bracket means c (FIGS. 12 and 23). As stated earlier herein, a bracket means c is associated with each of the connecting means 12a, 12', 13a, 14a, to the main frame 10. It is thus seen that the column or post 30b may be moved manually about the two axes 30f, 30i defined at opposite ends of the hinge plate 30d.

In operation, the front inner portion of the frame 30a of the mold mounting means 30 is normally connected to the lower end of a bracket 30g by means of a removable locking pin 30h (FIG. 4). Thus, when the molding means 25 is to be moved from an operative position such as that shown in FIG. 1 in solid lines and shown in FIG. 3 in broken lines, to an inoperative or transport position rearwardly of and in alignment with the main frame (FIGS. 3, 4 and 13), an operator may simply remove the locking pin 30h from the bracket 30g (which is secured to the main frame 10) and then successively swing the frame of the mounting means outwardly and then inwardly about the two axes 30f, 30i (FIG. 12) of hinge plate 30d heretofore described, to move the corresponding molding means 25 or 125, as the case may be, from the first operative position laterally offset of the main frame 10 to the second or transport position adjacent the rear end of the main frame as shown in solid lines in FIGS. 3, 4, 12 and 13.

Figure 14:
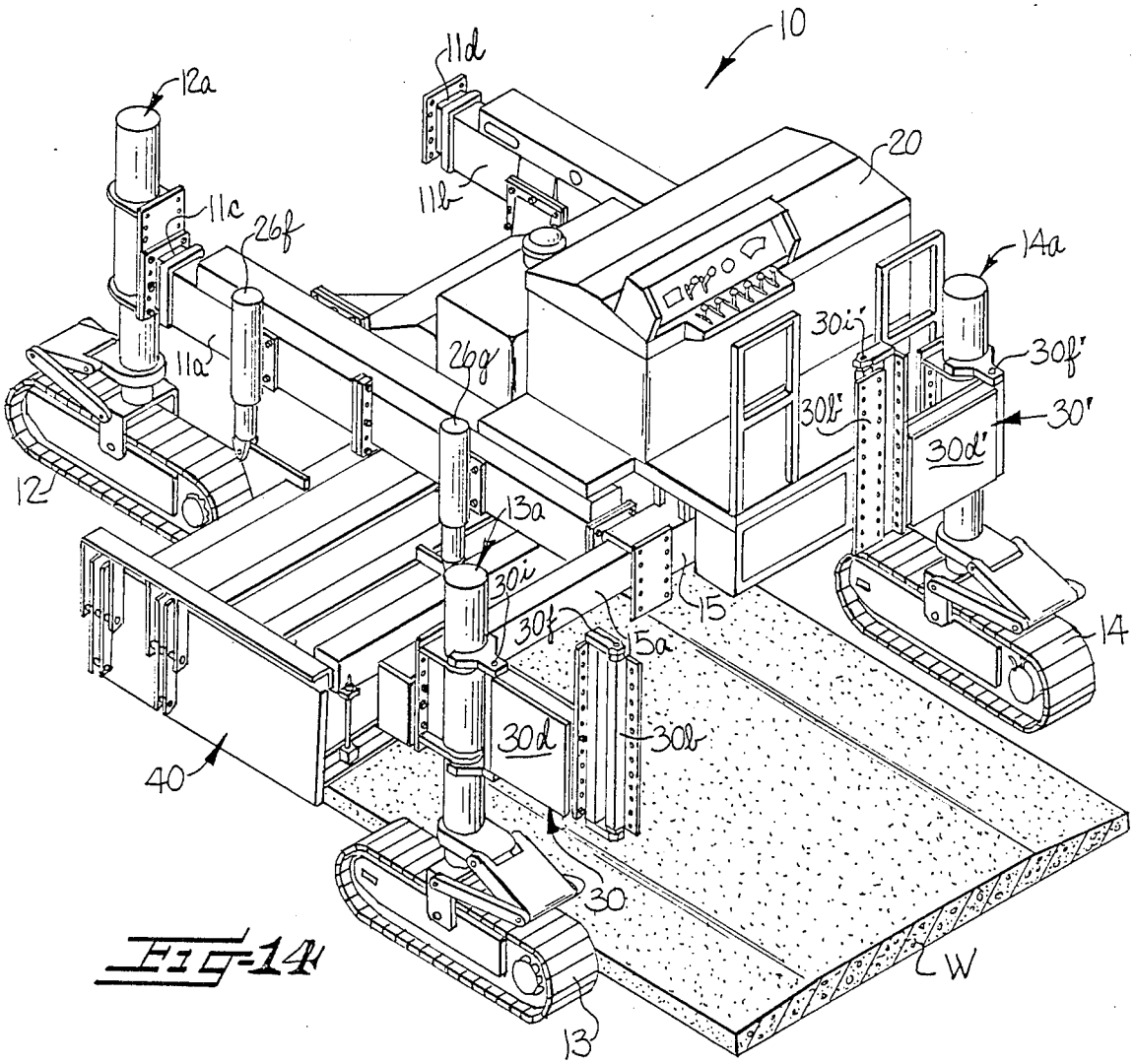
FIG. 14 is a perspective view similar to FIG. 1, with the offset molding means of FIG. 1 removed from the apparatus and wherein a narrow strip paving means is carried by the construction apparatus.
Figure 15:
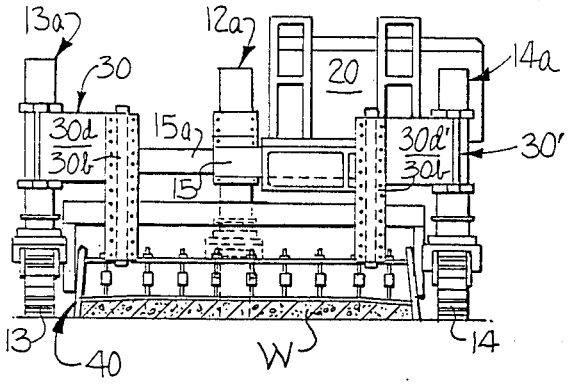
FIG. 15 is a rear elevation of the construction apparatus as shown in FIG. 14.
Figure 16:
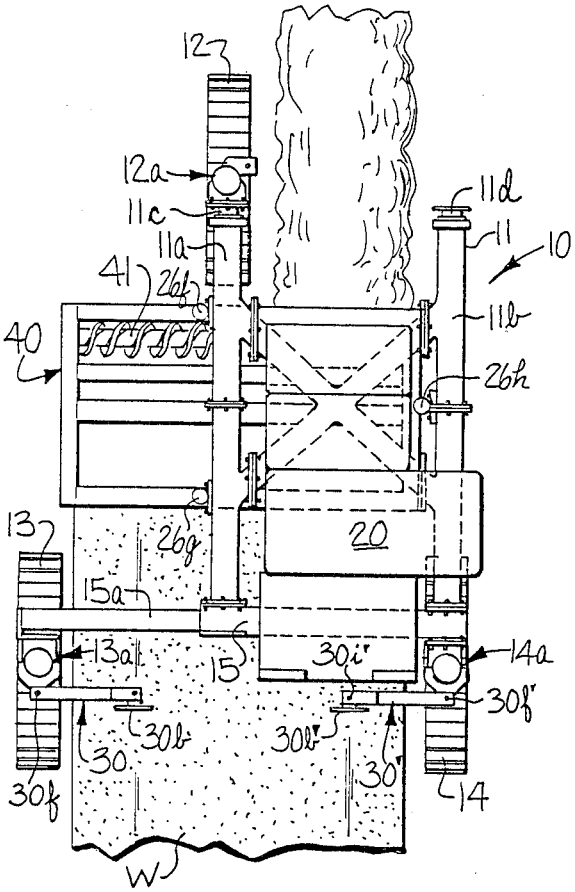
FIG. 16 is a schematic plan view of the apparatus as shown in FIG. 15.

In FIGS. 14 and 15, the construction apparatus is shown equipped with a slip molding means 40 shaped to continuously form a relatively narrow walkway W or other relatively narrow largely substantially flat strip of molding material. By comparing the illustrations of the apparatus in FIGS. 1 and 14, it can be appreciated that the conveyor A (FIGS. 3 and 4), the trimmer 25 and the curb and gutter molding means 26 have been removed from the apparatus and replaced with the relatively flat molding means 40 which partially underlies the main frame and is removably or detachably suspended therefrom by means of the rams 26f, 26g, 26h. It will be noted that the relatively flat molding means 40 extends laterally outwardly beyond the left-hand side of the main frame 10 (FIGS. 15 and 16). In order to accommodate the relatively narrow strip of paving material as it is being formed, it can be seen that the rear left-hand ground engaging means or track 13 has been adjusted outwardly relative to the main frame 10 in the manner heretofore described (see FIG. 24). It should be noted that this operation does not alter the construction or attachment of the mold mounting means 30, 30'. The molding means 25, 25' have been detached from the mounting means 30, 30' however.

Since front ground engaging means or track 12 is positioned in substantially vertical alignment with the left-hand side frame portion 11*a* in FIG. 14, it is seen that a three-point suspension is provided for the apparatus and that the track 12 engages the ground in front of the flat molding means 40 at a point intermediate the path of travel of the rear pair of ground engaging means or tracks 13, 14. Since the flat molding means 40 may be of construction well known in the art, a further more detailed description thereof is deemed unnecessary.

Figure 17:
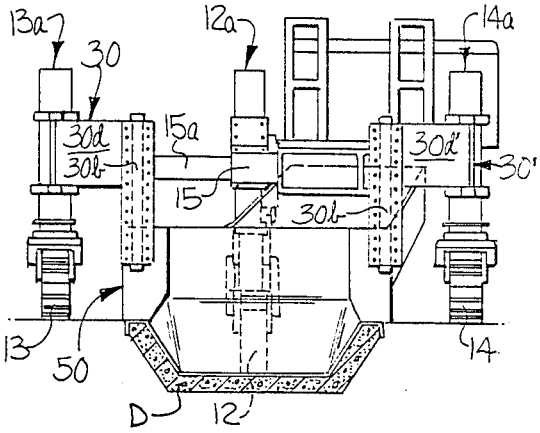
FIG. 17 is a rear elevation similar to FIG. 15, but wherein the apparatus is equipped with a molding means underneath the apparatus and configured or shaped in the form of a trough or gutter having sloping side walls.

It will be observed in FIG. 17 that the construction apparatus is equipped with a mold for forming a ditch D which may be of conventional construction, the ditch forming mold being indicated generally at 50. In other respects the illustration of FIG. 17 and 18 shows the apparatus in essentially the mode illustrated in FIG. 14, but in addition, FIGS. 17 and 18 particularly illustrate how the front track 12 may be adjusted to occupy a lower level than the rear pair of tracks 13, 14 so as to engage the ground at the bottom of the ditch being formed and in front of the ditch molding means 50 so as to stabilize the operation of the construction apparatus as it moves along the ground.

Figure 18:
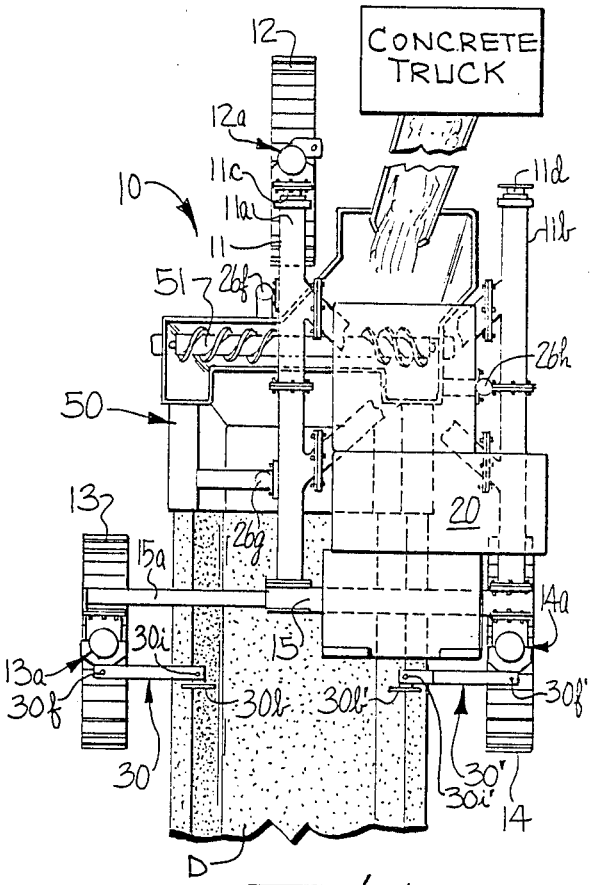
FIG. 18 is a top plan view of the apparatus as shown in FIG. 17.

It is apparent by referring to FIGS. 16 and 18 that the molding material is deposited on the ground by a truck or other vehicle and is located so that it will be to one side of the path of travel of the front track 12. Therefore, both of the molds 40, 50, which are used alternatively, are provided with respective driven distributing conveyors 41, 51 of conventional or other construction, for distributing the paving material as it is being smoothed out by the slip molding means 40, 50. Since the operation of the slip molding means 40, 50 is well known in the art, further description thereof is deemed unnecessary, it being sufficient to state that each of the molding means may be removably secured to the lower portions of the vertically adjustable brackets or rams 26*f*, 26*g*, 26*h* (FIGS. 4 and 5) in substantially the same manner as that in which the trimmer 26 is detachably connected to the rams 26*f*, 26*g*, 26*h*.

Figure 19:
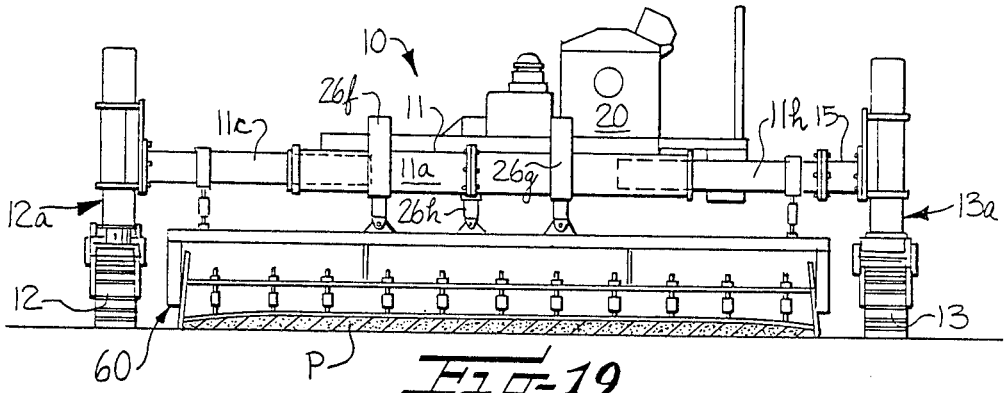
FIG. 19 is a side elevation of the apparatus arranged for forming a wide strip of paving material and wherein the ground engaging means or tracks have been repositioned 90° their previous position.
Figure 20:
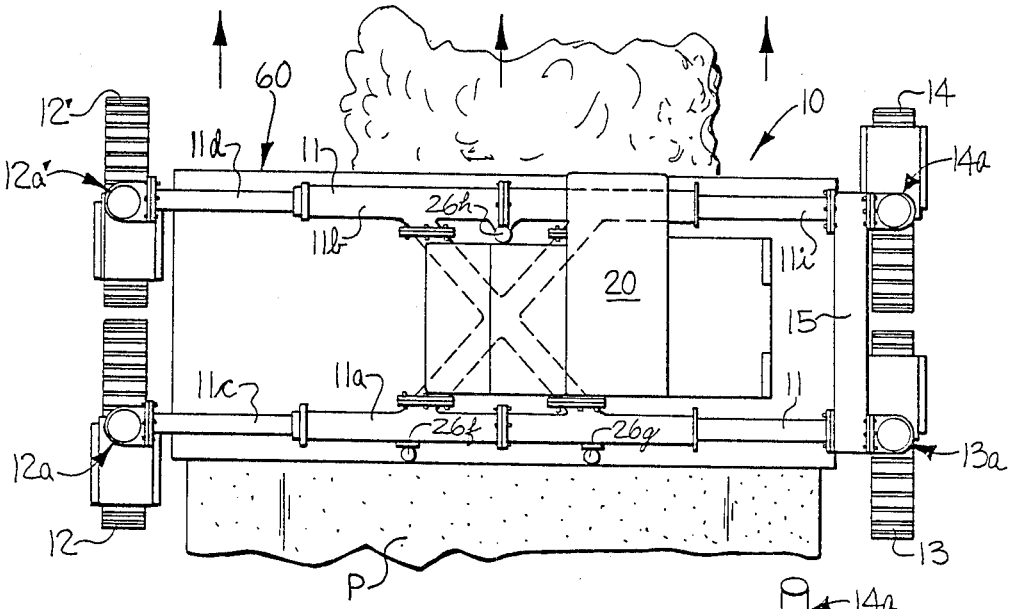
FIG. 20 is a top plan view of the apparatus as arranged in FIG. 19 showing the main frame greatly extended and the repositioned tracks.

FIGS. 19 and 20 illustrate a relatively flat strip molding means 60 which may be of the same general construction and operation as the relatively narrow strip molding means 40 in FIGS. 14 and 15. The flat strip molding means of FIGS. 19 and 20 is much wider than molding means 40 or 50 however. This provides a wide pavement P as illustrated. In this case, it will be noted that the construction apparatus of this invention is arranged so that all four of the longitudinally adjustable substantially horizontal beam members 11*c*, 11*d*, 11*h*, 11*i* extend outwardly a substantial distance from the body 11 of the main frame 10 and the distal ends of all four of the longitudinally adjustable and substantially horizontal beam members have thereon respective vertically adjustable ground engaging means 12, 12', 13 and 14. Additionally, in order to obtain the benefit of the wide width it will be observed in FIGS. 19–21 that the tracks or ground engaging means have been turned or reoriented about their steering axes defined by the columns a, b of the respective connecting means 12*a*, 12*a*', 13*a* and 14*a*.

The orientation of the tracks 12, 12', 13, 14 so that their rotary axes extend substantially parallel with the longitudinal axes of beam members 11*c*, 11*d*, 11*h*, 11*i* provides for the positioning of a very wide molding means 60 beneath the main frame 10 with the tracks 12, 12'and 13, 14 straddling the wide slip form molding means 60. It should be noted that the wide molding means 60 is suspended from the rams 26*f*, 26*g*, 26*h* in substantially the same manner as heretofore described with respect to the trimmer 26 (FIGS. 1, 3–5 and 10) and the slip form molding means 40 (FIGS. 14, 15 and 16), and 50 (FIGS. 17 and 18).

In the arrangements of the self-propelled construction apparatus shown in FIGS. 1–7, 10 and 13; FIGS. 8 and 9; FIG. 12; FIGS. 19–21; and FIG. 23, respectively, the owner of the apparatus may wish to omit the transverse frame member 15 and its telescoping beam member 15*a* for economic reasons, especially when neither of the slip form molding means 40, 50 (FIGS. 14–16; and FIGS. 17 and 18, respectively) are to be used with the main frame 10.

Figure 22:
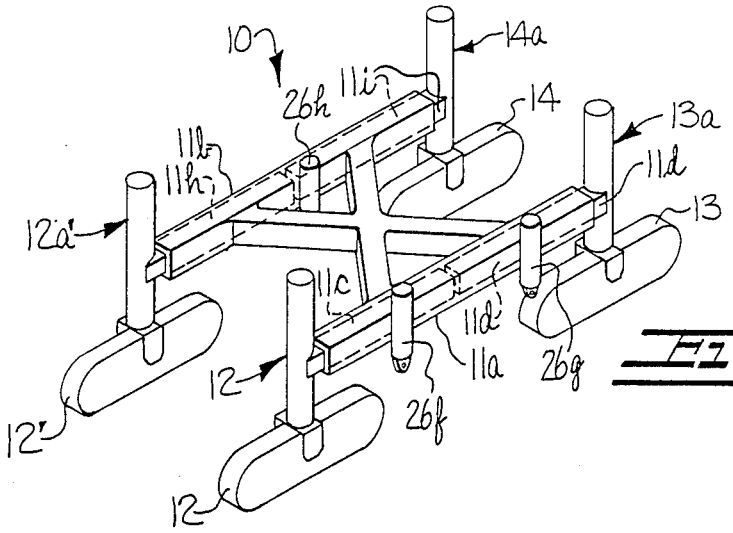
FIG. 22 is a schematic isometric view of the main frame showing the front and rear portions thereof equipped with respective pairs of movable ground engaging means, each of which ground engaging means is independently adjustable longitudinally and vertically with respect to the main frame of the apparatus.

In such an instance, the rear connecting means 13*a*, 14*a* with their respective movable ground engaging means or tracks 13, 14 are bolted directly to, and thereby detachably connected directly to the rear ends of the respective rear longitudinally adjustable substantially horizontal beam members 11*h*, 11*i* (FIG. 22). Thus, it can be appreciated that each of the four horizontal beam members 11*c*, 11*d*, 11*h*, 11*i* in FIG. 22 is independently and longitudinally adjustable relative to the body 11 of the main frame 10. Each longitudinally adjustable beam member 11*c*, 11*d*, 11*h*, 11*i* may be clamped or otherwise detachably secured in the desired adjusted position relative to frame body 11 by clamping bolts r and clamping bars s as shown in FIG. 23.

It will thus be understood that a multi-purpose self-propelled construction apparatus has been disclosed which permits ready adjustment and selective orientation thereof for a wide variety of different paving and/or molding functions.

In the drawings and specification there has been set forth a preferred embodiment of the invention, and although specific terms are employed, they are used in a generic and descriptive sense only, and not for purposes of limitation, the scope of the invention being defined in the claims.

That which is claimed is:

1. A self-propelled construction apparatus for continuously forming a paving material onto a suitable surface such as the ground, said apparatus comprising a main frame including a body having a front end and a rear end, a prime mover carried by said body, a molding means connected to said main frame for continuously forming paving material, at least one pair of independently and longitudinally adjustable substantially horizontal beam members directly connected to said body at one of said ends and defining one end of said main frame and wherein each of said beam members of said pair is adjustable independently of the other beam member, front and rear movable ground engaging means, and means connected to said ground engaging means for connecting said ground engaging means to said main frame at respective ends thereof for supporting the main frame and for varying the height of the main frame above the ground.

2. Apparatus according to claim 1 wherein said main frame further comprises a second pair of longitudinal adjustable substantially horizontal beam members connected to said body at the end opposite from said one end and defining the other end of the main frame.

3. Apparatus according to claim 1 wherein said main frame further comprises a second pair of independently and longitudinally adjustable substantially horizontal beam members connected to said body at the end opposite from said one end and defining the other end of said main frame, and wherein each of said beam members of said second pair is also independently adjustable.

4. Apparatus according to claim 1 wherein said main frame further comprises a substantially horizontal lateral beam member connected to said body and arranged substantially perpendicular to said pair of longitudinally adjustable horizontal beam members, said lateral beam member being mounted for inward and outward lateral adjustment relative to said body, and wherein said means connecting said movable ground engaging means to said main frame connects one of said movable ground engaging means to the outer end of said lateral beam member.

5. Apparatus according to claim 1 wherein said main frame further comprises a second pair of longitudinally adjustable substantially horizontal beam members interconnected with each other for movement as a unit, said second pair connected to said body adjacent the end opposite from said one end, said main frame further including a substantially horizontal lateral beam member arranged substantially perpendicularly to said second pair of beam members and mounted for inward and outward lateral adjustment relative to said second pair of beam members, and wherein said means connecting said movable ground engaging means to said main frame connects one of said movable ground engaging means to the outward end of said lateral beam member.

6. Apparatus according to claim 1, wherein each of said movable ground engaging means comprises an endless track.

7. Apparatus according to claim 1, wherein said means for connecting said movable ground engaging means to said main frame includes means for at times positioning the movable ground engaging means substantially parallel to said pair of longitudinally adjustable beam members for a forward orientation of the apparatus for offset molding and narrow paving, and for at other times positioning said movable ground engaging means in a lateral orientation at substantially right angles to said pair of longitudinally adjustable beam members for a lateral orientation of the apparatus for wide paving.

8. Apparatus according to claim 1 further comprising molding means for forming a continuous strip of paving material on the ground and means connecting said molding means to said main frame for angular movement between a first operative position laterally offset of said main frame and a second transport position adjacent one end of said main frame.

9. A self-propelled construction apparatus for forming a continuous strip of paving material having a predetermined shape on a suitable surface such as the ground, comprising a main frame having a front end and a rear end, front and rear movable ground engaging means, means connecting said ground engaging means to said main frame and for varying the height of the main frame, molding means for forcing the strip of paving material having a predetermined shape, and means connecting said molding means to said main frame for angular movement between a first operative position laterally offset of said main frame and a second transport position adjacent one end of said main frame.

10. A self-propelled construction apparatus for continuously forming paving material on a suitable surface such as the ground, said apparatus comprising a main frame having a front end and a rear end, front and rear movable ground engaging means, said rear movable ground engaging means comprising an axially aligned pair of ground engaging means, said front movable ground engaging means comprising a single ground engaging means and cooperating with said pair of rear ground engaging means so as to define a tri-supporting ground engaging means for the self-propelled construction apparatus, means for laterally adjusting inwardly and outwardly relative to said main frame one of said rear ground engaging means, and means connecting said ground engaging means to said main frame for supporting the main frame and for varying the height of the main frame above the ground, molding means for forming the paving material on the ground, and means connecting said molding means to said apparatus for angular movement between a first operative position laterally offset said main frame and a second transport position adjacent one end of said main frame.

11. A self-propelled construction apparatus for continuously forming paving material on a suitable surface such as the ground, said apparatus comprising a main frame having a front end and a rear end, front and rear movable ground engaging means, said rear movable ground engaging means comprising an axially aligned pair of ground engaging means, said front movable ground engaging means comprising a single ground engaging means positioned on a common side with one of said rear ground engaging means and cooperating with said pair of rear ground engaging means so as to define a tri-supporting ground engaging means for the self-propelled construction apparatus, said apparatus further comprising means for laterally adjusting inwardly and outwardly relative to said main frame a predetermined one of said rear ground engaging means, and means connecting said ground engaging means to said main frame for supporting the main frame and for varying the height of the main frame above the ground.

12. Apparatus according to claim 11 wherein said means for laterally adjusting one of said rear ground engaging means further comprises a substantially horizontal lateral beam member connected adjacent the rear end of said main frame and being arranged for inward and outward lateral adjustment relative to said main frame, and wherein said means for connecting said movable ground engaging means to said main frame connects one of said rear movable ground engaging means adjacent an outward end of said lateral beam means.

13. Apparatus according to claim 11 wherein said connecting means includes means for selectively connecting said front ground engaging means to either side of said main frame for accommodation of molding along either side of the apparatus.

14. Apparatus according to claim 11 further comprising molding means for forming the paving material on the ground and means connecting said molding means to said apparatus for angular movement between a first operative position laterally offset said main frame and a second transport position adjacent one end of said main frame.

* * * * *

UNITED STATES PATENT AND TRADEMARK OFFICE

CERTIFICATE OF CORRECTION

PATENT NO. : 4,789,266

DATED : December 6, 1988

INVENTOR(S) : Samuel Y. Clarke, Jr., et al.

It is certified that error appears in the above-identified patent and that said Letters Patent is hereby corrected as shown below:

Title page:

In the Abstract:

Line 15, delete "the" and insert --and--.

In the Specification:

Column 6, line 8, delete "shaped" and insert --is spaced-- (2nd occurrence).

Column 8, line 21, insert --is-- after "30b".

Signed and Sealed this

Eighth Day of August, 1989

*Attest:*

*Attesting Officer*

DONALD J. QUIGG

*Commissioner of Patents and Trademarks*